US005118041A

United States Patent [19]

Chastang et al.

[11] Patent Number: 5,118,041

[45] Date of Patent: Jun. 2, 1992

[54] LINEAR WATER SPRAY DEVICE FOR COOLING SHEET METAL

[75] Inventors: Georges J. B. Chastang, Coignieres; Pierre G. Lascoux, Plaisir; Paul L. B. Lefevre, Maurepas; Bernard C. R. Chezlepretre, Versailles, all of France

[73] Assignee: Bertin & Cie, Plaisir Cedex, France

[21] Appl. No.: 598,656

[22] PCT Filed: Apr. 20, 1989

[86] PCT No.: PCT/FR89/00184

§ 371 Date: Oct. 22, 1990

§ 102(e) Date: Oct. 22, 1990

[87] PCT Pub. No.: WO89/10203

PCT Pub. Date: Nov. 2, 1989

[30] Foreign Application Priority Data

Apr. 22, 1988 [FR] France ..... 88 05350

[51] Int. Cl.[5] ..... B05B 7/06

[52] U.S. Cl. ..... 239/424; 266/259

[58] Field of Search ..... 239/423. 424, 424.5, 239/590, 590.5; 266/259, 113

[56] References Cited

U.S. PATENT DOCUMENTS

| | | | |
|---|---|---|---|
| 4,711,431 | 12/1987 | Viannay et al. | 266/259 |
| 4,936,882 | 6/1990 | Chen et al. | 239/424 |
| 5,012,980 | 5/1991 | Viannay et al. | 239/423 |

*Primary Examiner*—Andres Kashnikow
*Assistant Examiner*—Lesley D. Morris
*Attorney, Agent, or Firm*—Breiner & Breiner

[57] ABSTRACT

A spray device is described in which the water spray from a water chamber is supplied to a spray head by cylindrical tubes inducing a head loss. The water from the tubes is guided by additional tubes into a water outlet channel forming a continuous slot. Water ejection mechanism are mounted on either side of the slot and in the air conduits. The water ejection mechanism are formed by vanes in which the flow of spray water is guided perpendicularly to the surface of the item to be treated. The vanes, which are segment shaped, are placed end to end along the length of the slot and form converging conduits for the air, ending in rectangular slot openings. A second embodiment is given for a vertical jet spray.

17 Claims, 7 Drawing Sheets

LINEAR WATER SPRAY DEVICE FOR COOLING SHEET METAL

The inventon relates to an apparatus for the linear spraying of water for the cooling of metal sheets, comprising a conduit supplied with compressed air and a longitudinal water chamber equipped with water flow-off means, the said means opening out between means for the directed ejection of the compressed air which are provided in the air conduit, to form a spray head.

The patent FR-A-2,578,449 makes known a spraying apparatus for the thermal treatment of metal sheets of large width, which has a cylindrical horizontal water-supply pipe equipped with a flow-off slit along its upper generatrix. This pipe is arranged in the vertical plane of symmetry of a hollow body supplied with compressed air and separated into two longitudinal conduits by means of a hopper which, at its inlet, receives the water flowing off from the pipe and which, at its outlet, forms a linear spray head. This head has a central water-outflow slit contained between two symmetrical rows of ports communicating with the longitudinal compressed-air supply conduits.

This apparatus is intended to allow wide variations in the flow of the cooling water, at the same time maintaining uniform distribution over the length, without the need for geometrical and/or dimensional modifications of the spray head. However, it emerged that the uniformity of the cooling jet to come in contact with the metal sheet to be treated depends greatly on the horizontality of the water-supply pipe and on the tolerances of the various component elements of the apparatus. In addition to the constant flow of water from one end of the spray head to the other, the elementary jets forming the film-like jet must reach the surface to be cooled in an identical direction and in planes perpendicular to the direction of run of the sheets from one edge of the sheet to the other. Now because of the production tolerances, arranging the compressed-air outlet ports at the same level as the water-supply slit can be conducive to deviations of some elementary jets in relation to the general direction, the result of these deviations being non-uniformity of cooling of the transverse zone of the sheet passing in front of the sprayer.

The object of the invention is an apparatus which is comparable to that described above, but in which the said disadvantages are eliminated.

The spraying apparatus according to the invention is characterized in that the means for the flow-off of the cooling water consist at least partially of cylindrical tubes distributed along the water chamber, the said tubes having characteristics of dimension and/or of shape which impart a considerable pressure loss to the stream of water passing through them, minimising the local pressure variations capable of occurring in the water chamber at the inlet of the tubes and defining directions of impact of the elementary spray jets which are identical over the entire length of the sprayer.

The explanations and figures given below by way of example will make it possible to understand how the invention can be put into practice.

FIG. 1 illustrates an exemplary embodiment of a linear spraying apparatus. This sprayer is intended more particularly for generating a film-like jet of great length, transverse relative to the metal sheet and directed downwards and can be used, for example, in an assembly for the thermal treatment of a run of metal sheets coming off a hot-rolling mill.

FIG. 2 is a cross-sectional view of the said apparatus according to II—II of FIG. 1, and FIG. 3 is a front view according to the arrow III of FIG. 2. The following general description is given with reference to these three figures.

Figure 1:
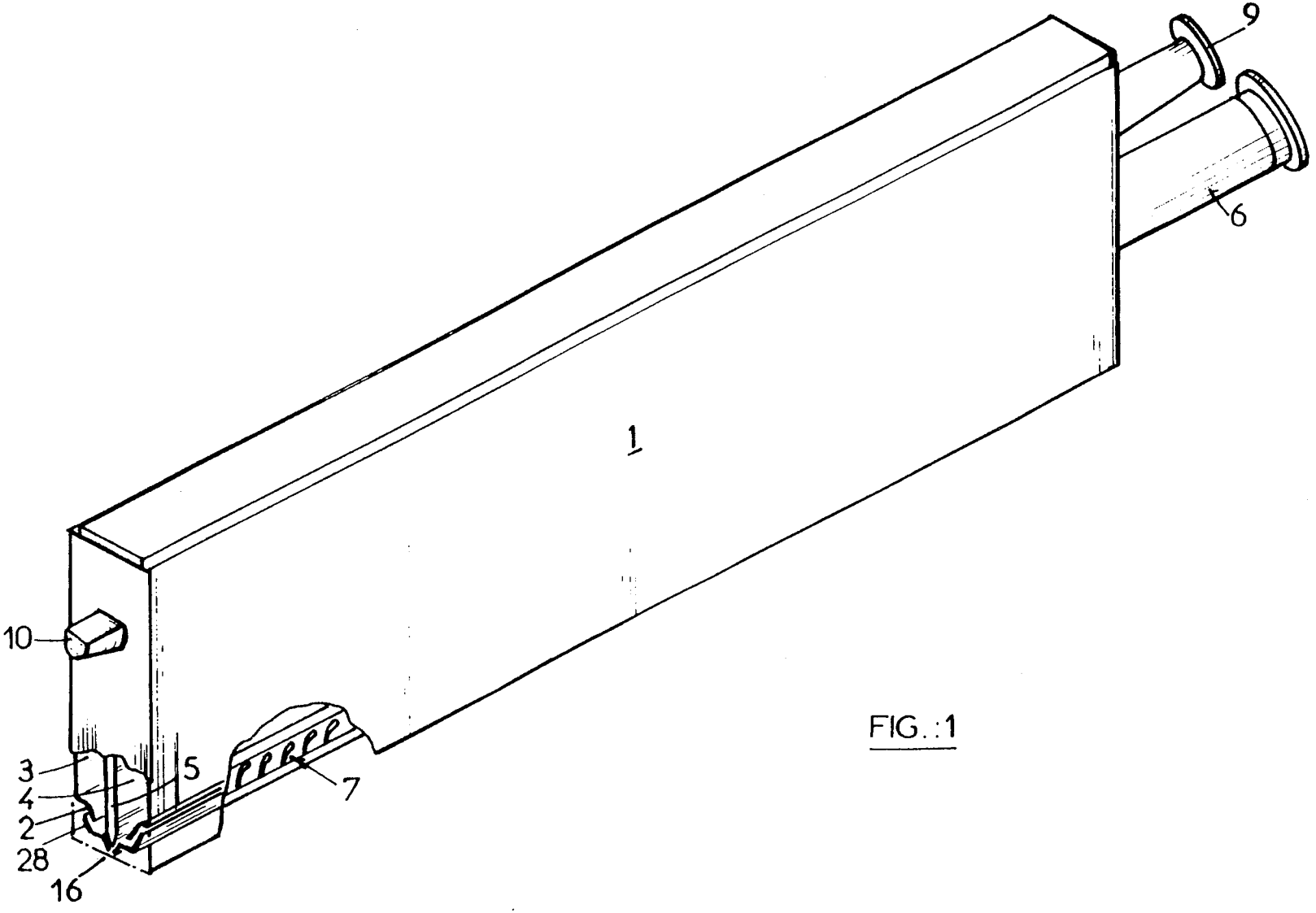
FIG. 1 is a partially cut away perspective view of an exemplary embodiment of a spraying apparatus according to the invention, the jet of which is directed downwards.

The spraying apparatus 1 takes the form of a long parallelepipedic box, the lower part of which is designed to form two independent air conduits 3 and 4 separated by a passage 5 in the vertical longitudinal plane of symmetry of the box 1. The conduits are closed on one of their longitudinal faces by field housings 2 and are supplied with compressed air at one of their ends 6. The lower part of the conduits has means 7 for the directed ejection of the compressed air, the said means extending longitudinally on either side of the passage 5 via which the cooling water arrives.

The upper part of the box 1 accommodates a longitudinal chamber 8 supplied with cooling water at one of its ends by means of a pipe 9. The water chamber, in its upper part, carries, in its longitudinal axis of symmetry, ports 10 equipped with flow-off means 11 which are accommodated at least partially in the passage 5 provided between the two air conduits 3, 4.

The flow-off means 11 comprise at least one pressure-loss tube 12, one of the ends of which is fastened in the port 10 of the water chamber 8 and the other end of which penetrates into a guide duct 13 of a cross-section larger than that of the pressure-loss tube, allowing the free but guided streaming of the cooling water. As is known, the pressure loss of the tubes is defined by their characteristics of dimension and/or of shape.

Figure 2:
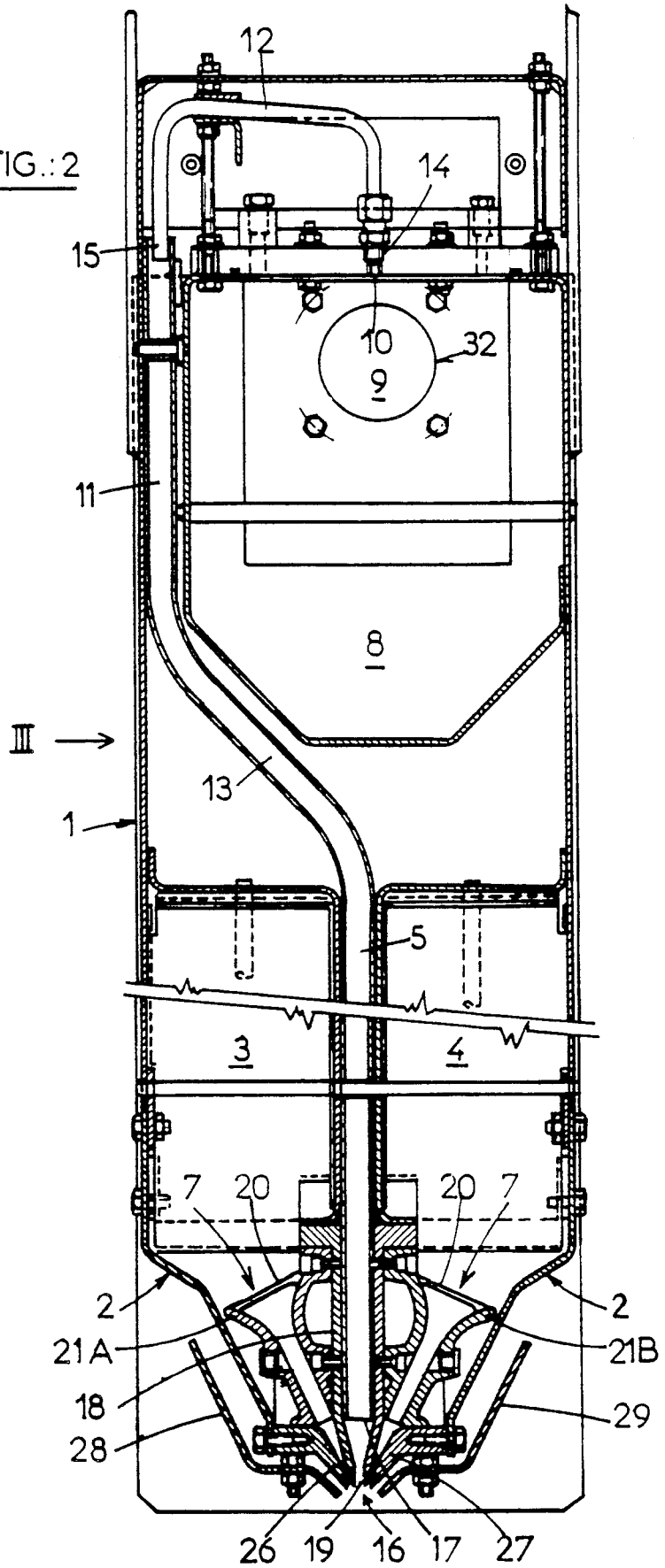
FIG. 2 is a cross-sectional view of the apparatus of FIG. 1.
Figure 4:
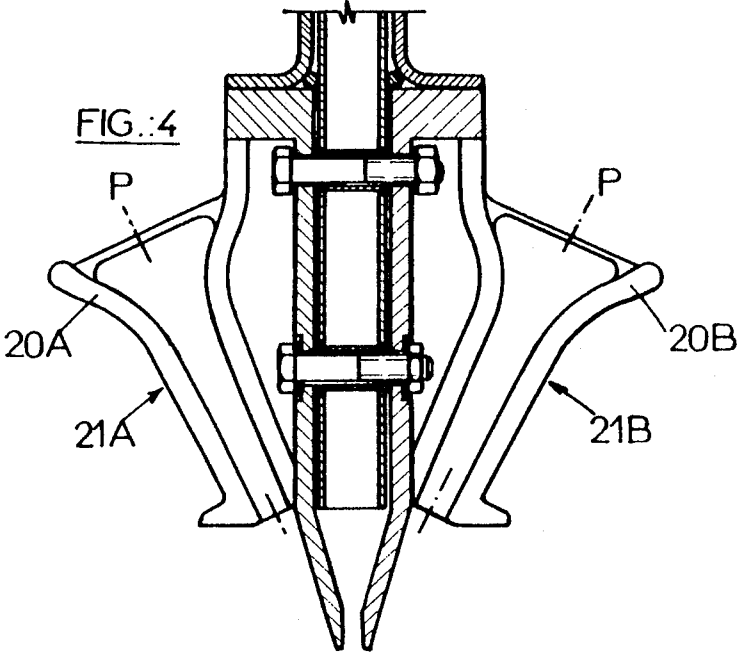
FIG. 4 is a view according to IV—IV of FIG. 3.

According to the exemplary embodiment shown in FIGS. 1 and 2, the pressure-loss tube 12 is approximately in the form of an upturned U, and the total pressure loss between the ends 14 and 15 is mainly attributable to the frictional losses in the straight parts of the tube 12, to which are added the pressure losses in the two bends, all these losses varying proportionally as a function of the flow. Since the inlet and outlet losses are unavoidable, but fixed for a given flow, the overall pressure loss is adjusted by varying the length of the tube, all else otherwise remaining equal. Preferably, to avoid a phenomenon of syphoning of the water chamber 8 and of the pressure-loss tubes 12 when the intake of water is interrupted, the inlet and outlet ends 14 and 15 of the said tubes are approximately in the same horizontal plane, this plane preferably being slightly above the level of the ports 10 provided in the upper wall of the water chamber 8.

To minimize the variations in the total pressure loss from one tube to the other, these variations being attributable to the finishing tolerances of the tubes, the inlets and outlets of the tubes are chamfered internally, thus guaranteeing an identical form of the mouths of all the tubes and therefore the equality of the corresponding inlet/outlet pressure losses, if appropriate at the expense of a negligible variation in length.

The function of the pressure-loss tubes 12 is to regulate the flow of the cooling water delivered to the spray head. In fact, as is known, the flow in a tube varies as the square root of the pressure difference between the inlet and the outlet of the tube. Now the pressure of the water over the entire length of the water chamber is not constant because of the local hydrodynamic and/or dimensional variations because the upper wall of the chamber carrying the ports is not perfectly horizontal and because the chamber is supplied at only one end. This asymmetry of supply is the more appreciable, the lower the supply pressure of the chamber. Now studies have shown, among other things, that in a film-jet sprayer, the uniformity of the jet improves with the reduction in the speed of the water arriving in front of the spraying-air nozzles. The best result is obtained with a low speed corresponding to streaming.

To guide the water coming out of the end 15 of the pressure-loss tube towards the spray head 16, the flow-off means 11 also possess a guide duct 13 of a cross-section sufficient to allow, within the limits of the flows allowed by the pressure-loss tube, a streaming directed by the walls of the latter. For production reasons and also to prevent the water from streaming along a preferred path, for example a generatrix of a tube of circular cross-section, the tubes used have a rectangular cross-section, the large faces of which are arranged parallel to the vertical plane of symmetry of the sprayer. The dimensional ratio between the adjacent sides of the rectangle is, for example, of the order of 1,5. The guide ducts 13 form a continuous film extending from one end of the sprayer to the other.

According to the exemplary embodiment illustrated, the guide ducts 13 are curved in such a way that their lower part comes to rest in the passage 5 provided between the air conduits 3 and 4. The outlet end 17 of the guide ducts are secured in a prism-shaped water-outflow channel 18 forming a continuous slit 19.

Figure 3:
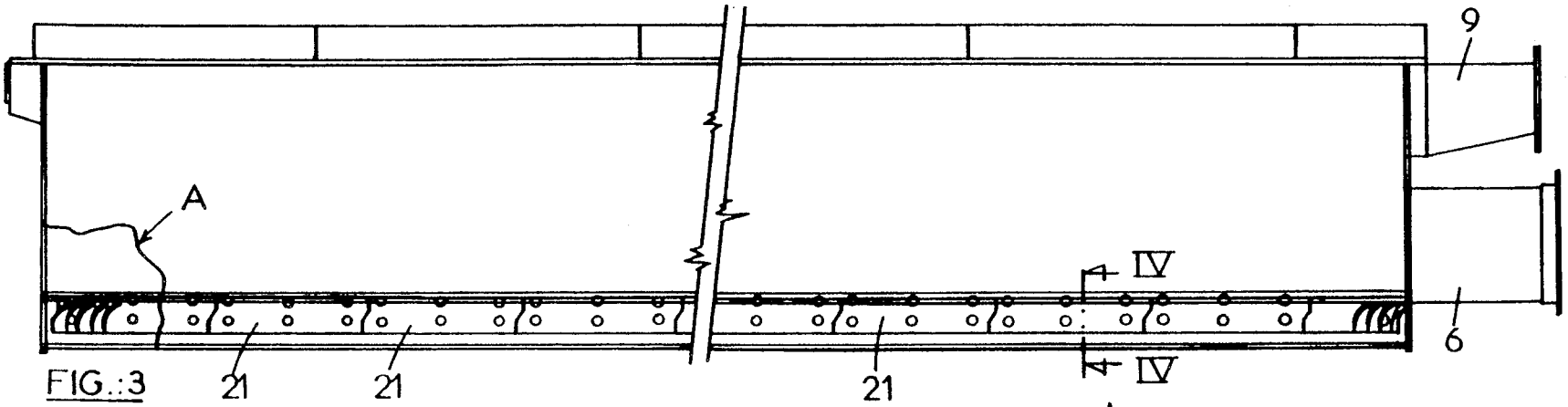
FIG. 3 is a view according to the arrow III of FIG. 2.
Figure 3A:
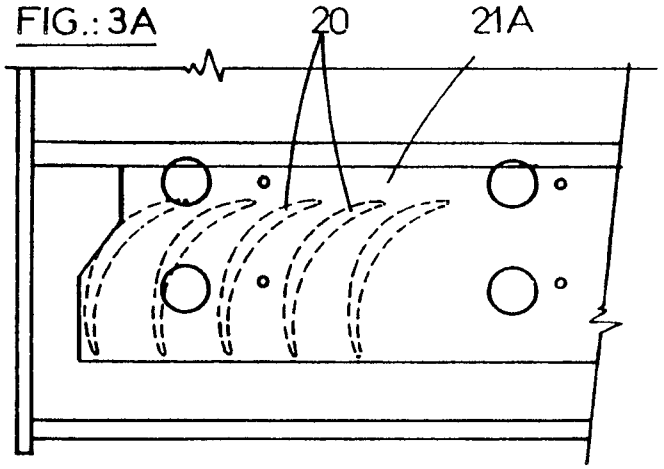
FIG. 3A is an enlarged view of the portion A of FIG. 3.

The spray head 16 in particular consists of the water-outflow channel 18 and of means 7 for the directed ejection of the compressed air. As described above, these means extend on either side of the continuous slit 19 formed by the water-outflow channel 18. As was noted in the analysis of the abovementioned French patent, the quality of the treated product depends on the uniformity of the jet, but also on its impact direction in relation to the transverse cooling zone, thus making it necessary to conduct a strict local check not only of the flow of cooling water, but also of the direction of the spray jet resulting from the combination of the compressed-air streams entering the means of directed ejection. To avoid the disadvantages inherent in the direct ejection of compressed air through slits or ports, the production tolerances of which mean that their average direction or their dimensions have variations from one end of the spray head to the other which are detrimental to the constancy of the direction, there are compressed-air guide means consisting of blades 20. These blades are mounted behind one another so as to form blading segments 21A, 21B (FIG. 3A) capable of being fastened successively to one another, in order to form, in each of the air conduits 3 and 4 and on either side of the water-outflow channel 18, a blading extending from one end of the spray head to the other. The curvature of the blades is such that the air stream introduced at one end of the air conduits is directed perpendicularly relative to its inflow direction. The plane tangent to the trailing edge of the blades must preferably be perpendicular to the surface of the product to be treated. The planes of symmetry P of the left blades 20A and right blades 20B are inclined relative to the longitudinal plane of symmetry of the sprayer at equal angles (of the order of 25°), so that the air jets coming from the right and left blades intersect in the said plane which is also the streaming plane of the cooling water. The impact of the air at high speed on the water at low speed causes the water to be broken into droplets which are subsequently driven along and thrown onto the metal sheet running past.

Figure 6:
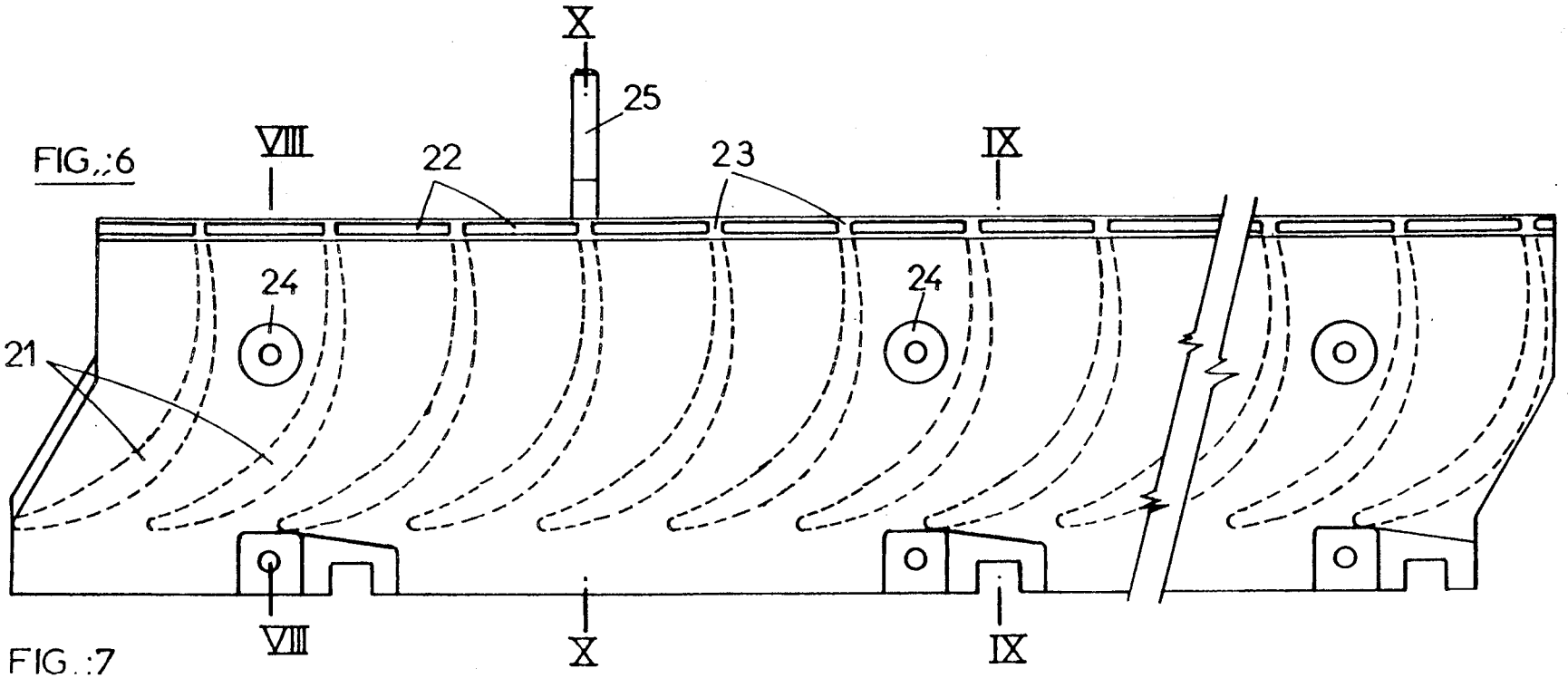
FIG. 6 is a front view of a blading segment.
Figure 7:
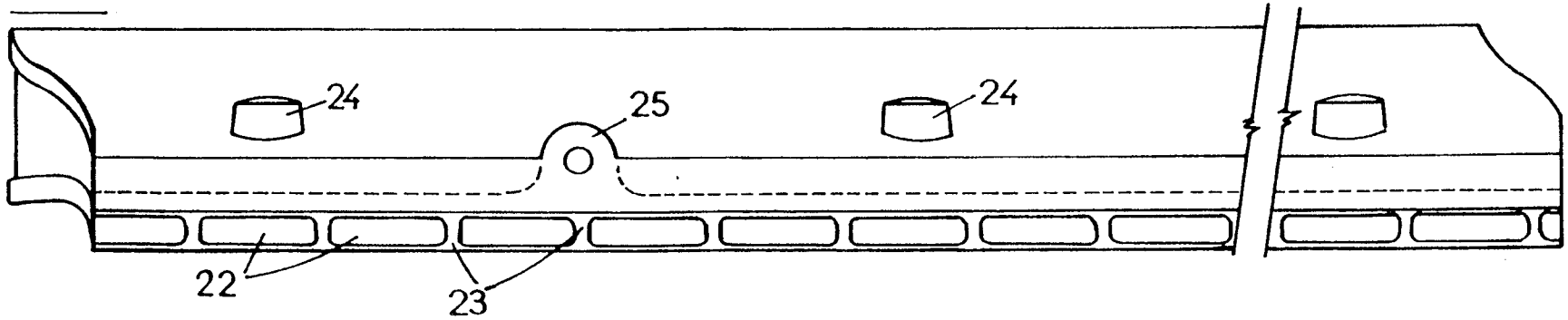
FIG. 7 is a top view of the segment of FIG. 6.
Figure 8:
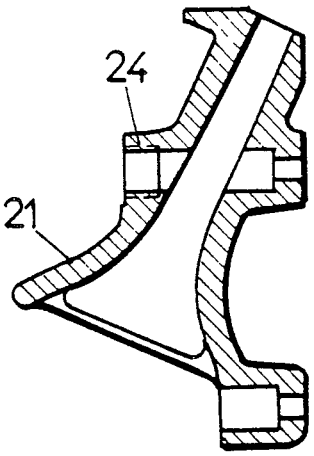
FIG. 8 is a sectional view according to VIII—VIII of FIG. 6.
Figure 9:
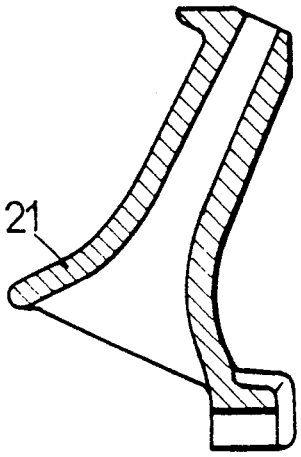
FIG. 9 is a sectional view according to IX—IX of FIG. 6.
Figure 10:
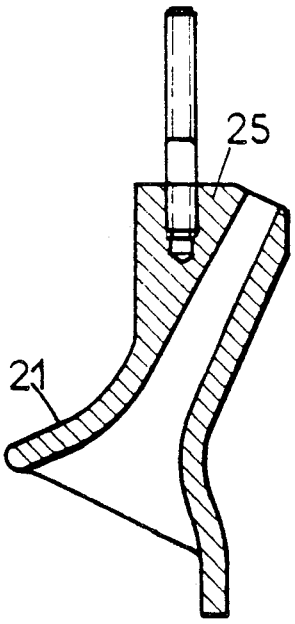
FIG. 10 is a sectional view according to X—X of FIG. 6.

According to one embodiment of the sprayer, the blading segments 21A, 21B (FIGS. 6, 7) take the form of prism-shaped cast-steel pieces, the cross-section of which has two curved and convergent opposite walls. The blades 21 are arranged between these walls and are fixed to them. The leading edges of the blades are retained in the widest part of the pieces, the form of which emerges clearly from FIGS. 6 to 10. The blades form between them laterally convergent ducts opening out in the form of rectangular ports 22 and separated from one another by transverse walls 23 of small thickness, corresponding to the trailing edges of the blades not generating any appreciable longitudinal division of the air jet. These pieces 21, on their various faces, are equipped with bosses 24 and 25 making it possible to fasten them to the water-outflow channel 18. After the blading segments 21 have been fastened, the bottoms of the air conduits 3 and 4 are closed by sealed housings 2, at the end of which there are outflow lips 26, 27 extending, substantially in alignment, that lateral inner wall of the blading segments not adjacent to the water-outflow channel beyond the water-outflow slit 19. These lips delimit a volume forming a spraying chamber.

If appropriate, there is a thermal protection of the spray head, which consists of two screens 28, 29 fastened to the outflow lips 26, 27.

Figure 11:
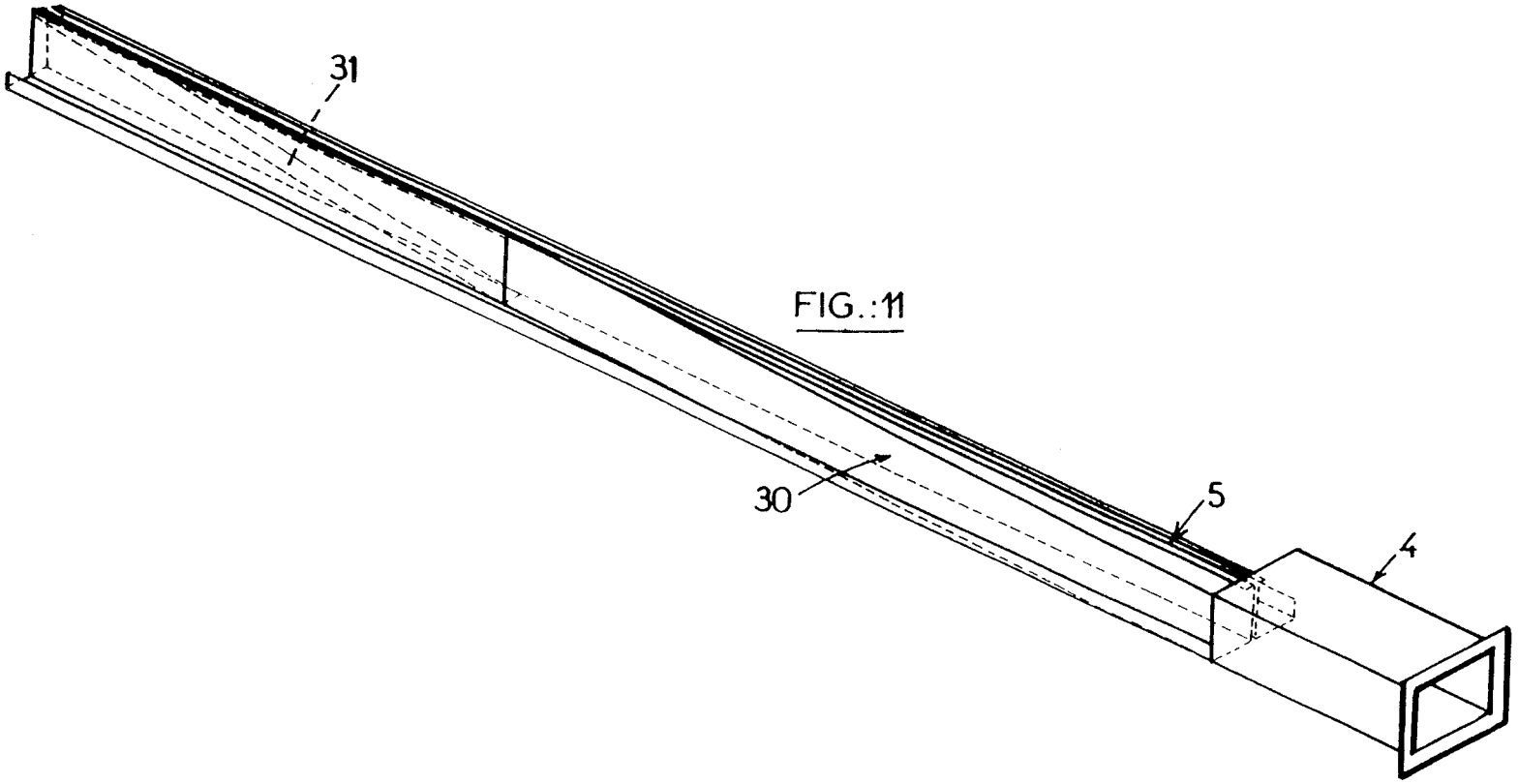
FIG. 11 is a perspective view of the air conduits.
Figure 12:
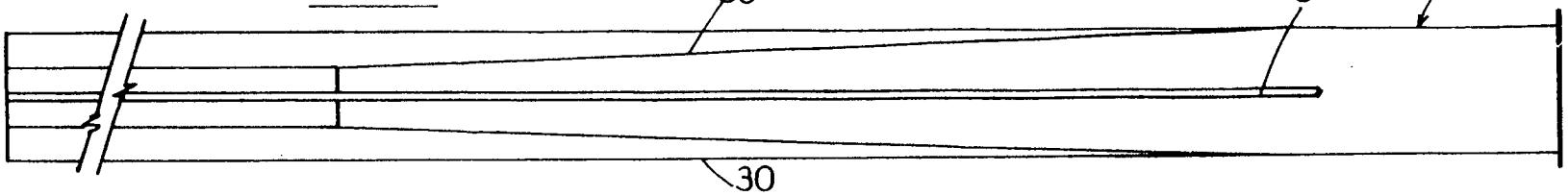
FIG. 12 is a view in horizontal projection of the air conduits of FIG. 11.

The blades described above make it possible to obtain elementary air jets formed by each port and of completely specific directions. However, to obtain a good uniformity of spraying from one end of the sprayer to the other, the flow and the pressure of the spraying air supplying each of the elementary jets must be completely constant over the entire length of the conduits. In the adopted configuration, the compressed air is introduced at the end of the conduits 3 and 4 which have a cross-section decreasing as a function of the distance from the inlet, in order to obtain a constant air speed upstream of the blades. This reduction in cross-section can be obtained, for example, as shown in FIGS. 11 and 12, by causing the lateral walls 30 opposite the walls forming the passage 5 to converge over at least some of the length of the conduit and then, over the rest of the length, causing the wall 31 opposite the spray head and adjacent to the walls 30 to converge. Any other embodiment, the purpose of which is to obtain a constant air speed upstream of the blades, is also possible, such as, for example, a supply of compressed air distributed at several points in the conduits.

It can be expedient to obtain a spray jet which, over the length of the sprayer, has special flow and pressure characteristics, in order, for example, to obtain a slight cooling at the ends corresponding to the edges of the metal sheet, whilst cooling is at a maximum in the central part. It will be easy to provide the desired profile by ensuring that the cooling water for the spray head is supplied by means of frictional pressure-loss tubes of different characteristics.

The adjustment of the spraying length, for example as a function of the widths of the metal sheets, can be obtained by means of an adjustable shut-off device 32 (FIG. 2) located inside the water chamber 8 so as to make it possible to shut off some of the ports 10 provided in the wall of the chamber for the passage of the cooling water. This device is similar to that described in French patent application no. 8805351, which is filed on this same date in the name of Messrs BERTIN and which will not be described in more detail.

Figure 5:
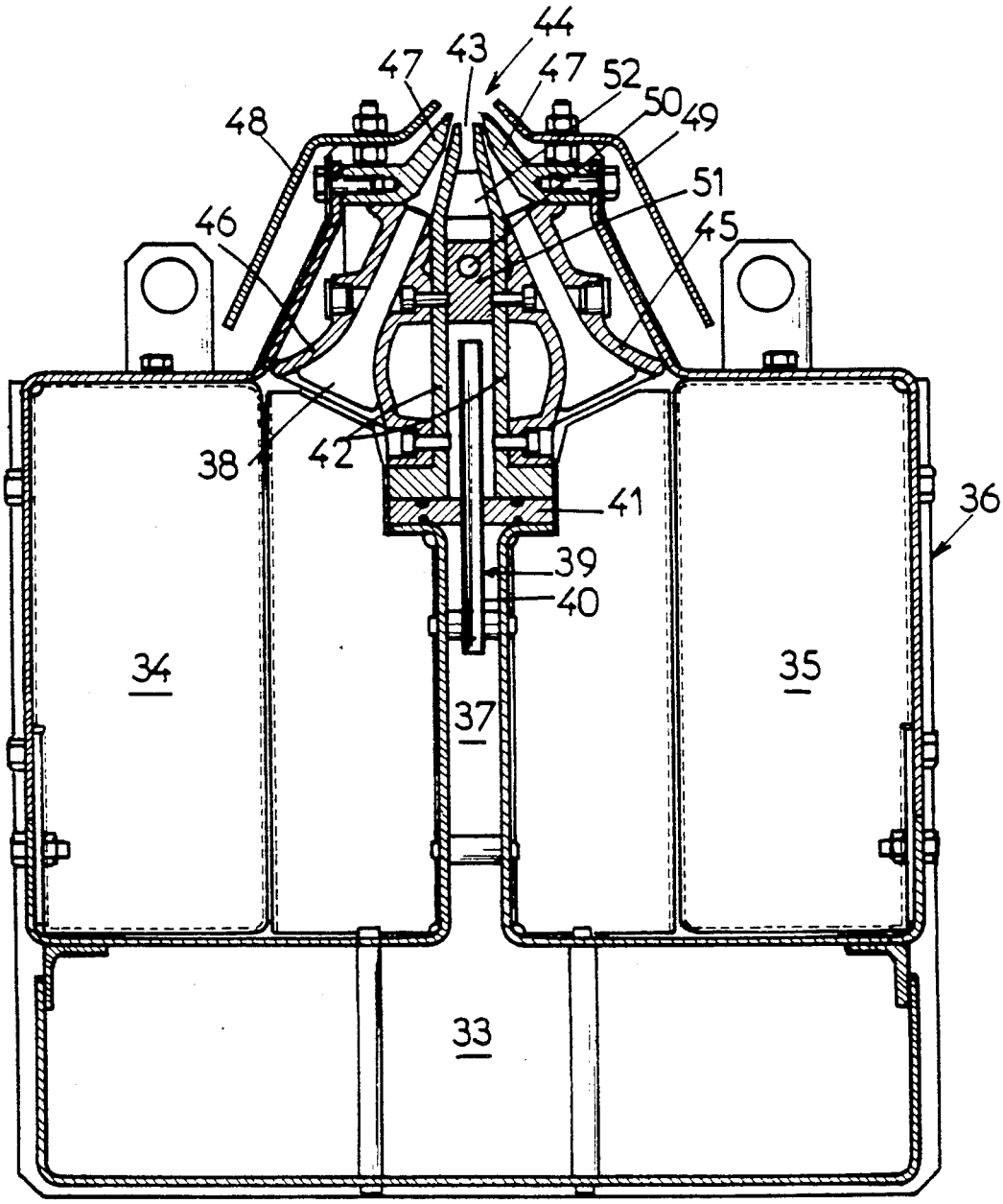
FIG. 5 is a cross-sectional view of an exemplary embodiment of an apparatus, the jet of which is directed upwards.

FIG. 5 illustrates another embodiment of a sprayer according to the invention, intended more particularly for generating a film-like jet of great length which is directed upwards. Because of the direction of the jet, the positions of the water chamber 33 and of the air conduits 34 and 35 are reversed in relation to those of the preceding embodiment.

The sprayer takes the form of a long parallelepipedic box 36, of which the lower part is designed to form a water chamber 33 and the upper part is designed to form two independent air conduits 34 and 35 separated by a passage 37 in the vertical longitudinal plane of symmetry of the box 36. This water chamber and these conduits are supplied with water and compressed air at one of their ends.

As in the embodiment shown in FIG. 1, the conduits have a cross-section decreasing as a function of the distance from the inlet.

The upper part of the conduits has means 38 for the directed injection of compressed air, which extend longitudinally on either side of the passage 37 via which the cooling water arrives.

The water chamber 33, in its upper part, carries, in its longitudinal axis of symmetry, flow-off means 39 which are accommodated at least partially in the passage 37 provided between the two air conduits 34, 35.

The flow-off means consist of straight and cylindrical pressure-loss tubes 40 passing sealingly and perpendicularly through a shut-off plate 41 closing the passage 37, the axis of the tubes being in the vertical plane of symmetry of the passage.

The dimensional characteristics of the pressure-loss tubes are provided as a function of the desired regulation of the flow of water delivered to the spray head. To minimize the action of the edges of the inlet and outlet ports of the tubes, these are internally chamfered.

The end of the tubes 40 opposite that directed towards the passage 37 and the water chamber 33 opens into a prism-shaped water-outflow channel 42 having a continuous slit 43 and possessing partitions 52, each tube opening out in the axis of the gap located between two consecutive partitions.

The spray head 44 consists of the water-outflow channel 42 and of the means 38 for the directed ejection of compressed air. These means, similar to those described in the preceding exemplary embodiment, extend on either side of the continuous slit 43. The ejection means 38 consist of blading segments 45, 46 arranged successively over the entire length of the slit, so as to form a continuous strip on each side of the slit. The convergent walls of the blades are extended, on one side, by the convergent wall of the water-outflow channel forming the slit and, on the other side, by outflow lips 47 extended beyond the edges of the slit 43. If appropriate, the spray head is protected by thermal screens 48, 49.

The mode of operation of the spray head, as described above, is slightly different because the water arriving via the pressure-loss tubes 40 must overcome gravity and have a sufficient pressure to allow it to gush into the outflow channel 42. To make the fractionation and spraying of the water jet easier, in its axis and perpendicularly to this there is a jet breaker 50 which, in the exemplary embodiment, takes the form of a cylindrical rod arranged inside the channel 42 and extending longitudinally from one end of the latter to the other. The rod is held from place to place by supports 51 or partitions 52 arranged perpendicularly to this longitudinal plane of symmetry of the slit and of the channel.

The preceding descriptions correspond to particular embodiments, and all or some of the various elements described can be replaced by technical equivalents, without departing from the scope of the invention.

We claim:

1. Linear apparatus for spraying cooling water comprising a first conduit and a second conduit supplied with compressed air, and a longitudinal water chamber equipped with a water flow-off means which has an outlet between a directed air ejection means provided in said first conduit and said second conduit so as to form a spray head, wherein said water flow-off means comprises cylindrical tubing positioned along the water chamber, said tubing being sized and longitudinally shaped so as to impart a pressure loss to water passing through said tubing, said pressure loss being greater than local pressure variations which can occur upstream in the water chamber at said tubing's inlet.

2. Linear spraying apparatus according to claim 1 wherein said tubing is sized and longitudinally shaped so as to add bend losses to inlet and outlet losses and introduce mainly frictional losses proportional to said tubing's length so as to obtain predetermined water distribution profiles from one end of the spraying apparatus to the other end of the spraying apparatus.

3. Linear spraying apparatus according to claim 1 wherein the cylindrical tubing is substantially U-shaped and has a first end fastened in one port of a row of ports provided in the water chamber and a second end penetrating into one end of a guide duct which has a cross-section larger than that of the cylindrical tubing so as to thereby guide water through the directed air ejection means.

4. Linear spraying apparatus according to claim 3 wherein the guide duct has a rectangular cross-section and is shaped so that a first end of the duct is accommodated in a longitudinal passage present between the first and second conduits and a second end of the guide duct opens into a prism- shaped water outflow channel which forms a continuous slit.

5. Linear spraying apparatus according to claim 4 wherein the guide duct is arranged so as to form a continuous film extending from one end of the spraying apparatus to the other.

6. Linear spraying apparatus according to claim 3 wherein said first and second ends of said substantially U-shaped tubing are each present in an identical horizontal plane located above said row of ports provided in the water chamber.

7. Linear spraying apparatus according to claim 1 wherein the cylindrical tubing passes perpendicularly through a shutoff plate so as to close a longitudinal passage which is present between said first and second conduits, and wherein said tubing's axis is present in the vertical plane of symmetry of said longitudinal passage.

8. Linear spraying apparatus according to claim 7 wherein said tubing has a portion which is directed towards the longitudinal passage and the water chamber opens into a prism- shaped water outflow channel having a continuous outflow slit arranged between the directed air ejection means of said first conduit and said second conduit.

9. Linear spraying apparatus according to claim 8 wherein the water outflow channel has partitions with spaces between said partitions, and a tube means is present which opens out along an axis of a space which is present between two consecutively spaced partitions.

10. Linear spraying apparatus according to claim 8 wherein a jet breaker is present along the axis of the cylindrical tubing in the water outflow channel.

11. Linear spraying apparatus according to claim 1 wherein the directed air ejection means consists of a plurality of blades arranged one behind another in each of the first and second conduits so as to form a blading extending from one end of the spray head to the other, said blades being constructed and arranged such that an air stream introduced at one end of the first and second conduits is directed perpendicularly relative to said air stream's inflow direction and a plane which is tangent to said blade's trailing edge is perpendicular to a surface to be treated with said spraying apparatus.

12. Linear spraying apparatus according to claim 11 wherein said blade's of said first and second conduits have planes of symmetry which are inclined relative to the longitudinal plane of symmetry of the spraying apparatus at equal angles so that air jets coming from the blades intersect in said longitudinal plane of symmetry.

13. Linear spraying apparatus according to claim 12 wherein the blades are blading segments in the form of prism-shaped pieces having a cross-section of two curved and convergent opposite walls between which are retained blades which form convergent ducts opening out in a form of rectangular ports separated from one another by transverse walls formed by the trailing edges of the blades.

14. Linear spraying apparatus according to claim 13 wherein the blading segments are fastened onto a side of the water outflow channel.

15. Linear spraying apparatus according to claim 14 wherein outflow lips extend in substantial alignment along the blading segments not adjacent to the water outflow channel beyond an edge of a water outflow slit so as to form a spraying chamber.

16. Spraying apparatus according to claim 11 wherein each cross-section of the first and second conduits decrease from an air supplied end of said conduits in such a manner as to to obtain a constant air speed upstream of the blades.

17. Linear spraying apparatus according to claim 10 wherein the jet breaker consists of a cylindrical rod located inside the water outflow channel and extends longitudinally from one end of said channel to the other.

* * * * *